US005768673A

United States Patent [19]

Morigami

[11] Patent Number: 5,768,673

[45] Date of Patent: Jun. 16, 1998

[54] INDUCTION HEAT FUSING DEVICE AND A FUSING ROLLER USED IN AN INDUCTION HEAT SUFING DEVICE

[75] Inventor: Yuusuke Morigami, Toyohashi, Japan

[73] Assignee: Minolta Co., Ltd., Osaka, Japan

[21] Appl. No.: 740,275

[22] Filed: Oct. 25, 1996

[30] Foreign Application Priority Data

Oct. 27, 1995 [JP] Japan ..... 7-280537

[51] Int. Cl.[6] ..... G03G 15/20

[52] U.S. Cl. ..... 399/330; 219/216; 219/619; 219/634

[58] Field of Search ..... 399/330, 335, 399/336; 219/216, 619, 634, 635

[56] References Cited

U.S. PATENT DOCUMENTS 5,552,582 9/1996 Abe et al. ..... 219/619

5,568,235 10/1996 Amarakoon ..... 399/319

FOREIGN PATENT DOCUMENTS

| | | |
|---|---|---|
| 0 649 072 | 4/1995 | European Pat. Off. . |
| 59-33474 | 2/1984 | Japan . |
| 59-33475 | 2/1984 | Japan . |
| 59-33476 | 2/1984 | Japan . |
| 59-33477 | 2/1984 | Japan . |

*Primary Examiner*—Joan Pendegrass
*Attorney, Agent, or Firm*—McDermott, Will & Emery

[57] ABSTRACT

An induction heat fusing device comprises a fusing roller and an induction coil induces an induction current in the fusing roller. The fusing roller has a nonmagnetic metallic hollow roller with good heat conduction properties and a magnetic metal layer formed on the outer peripheral surface of said roller that is heated by means of an induction current induced by the induction coil.

55 Claims, 4 Drawing Sheets

INDUCTION HEAT FUSING DEVICE AND A FUSING ROLLER USED IN AN INDUCTION HEAT SUFING DEVICE

BACKGROUND OF THE INVENTION

1. Field of the Invention

The present invention relates to a fusing device used in image forming apparatuses such as copying machines, printers and facsimile machines and to a fusing roller used in the fusing device and more particularly, to an induction heat fusing device that utilizes induction heating to fuse a toner image to a recording medium and to a fusing roller used in said induction heat fusing device.

2. Description of the Related Art

Electrophotographic image forming apparatuses are provided with a fusing device that fuse a toner image which was transferred onto a recording medium such as a recording paper and a transfer material to the recording medium. This fusing device has, for example, a fusing roller (heating roller) that thermally fuses toner on a sheet and a pressing roller that presses against said fusing roller to pinch and hold the sheet. The fusing roller is formed in a hollow shape and a heat generating body is retained in the center core of this fusing roller by a retention means. The heat generating body is comprised by a cylindrical heater, such as for example, a halogen lamp and generates heat by means of a fixed voltage being applied to said body. Because this halogen lamp is positioned at the center core of the fusing roller, heat generated from the halogen lamp is evenly radiated onto the inner wall of the fusing roller forming an even temperature distribution in the circumferential direction on the outer wall of the fusing roller. The outer wall of the fusing roller is heated up to a temperature (for example, 150° to 200° C.) suitable for fusing. In this state, the fusing roller and pressing roller rotate while making contact to hold the sheet which has toner adhering to it. The toner on the sheet dissolves at the contact portion (hereinafter referred to as the nip portion) between the fusing roller and pressing roller by means of the heat of the fusing roller and is fused to the sheet by the pressure exerted from both rollers. After the toner fuses, the sheet is fed by a paper delivery roller following the rotation of the fusing roller and pressing roller and is then fed out to a paper delivery tray.

In the above-mentioned fusing device provided with a heat generating body comprised by, for example, a halogen lamp, a comparatively long amount of time (hereinafter referred to as pre-heating time) was required until the temperature of the fusing roller reached the fixed temperature suitable for fusing after the power supply was turned ON. During that time operators were not able to use the image forming apparatus and were forced to wait a long time. In contrast, problems such as increases in the power consumption of the fusing device occurred which worked against reductions in energy consumption occurred by applying a large quantity of power to the fusing roller for the purpose of reducing the pre-heating time to improve the operability for the users. Therefore, in order to increase the value of the products such as image forming apparatuses, the coexistence of reducing energy consumption (lower power consumption) in fusing devices and improving the operability for users (quick prints) has attracted more and more attention as an important topic.

As illustrated in Japanese Laid-open Patent Application Sho 59-33477, an induction heat type fusing device that uses high-frequency induction as the heat source to improve the electricity-to-heat exchange efficiency and thereby reduce the pre-heating time has been proposed as a device to satisfy the requirements as stated. This induction heat fusing device is arranged with a coil inside the hollow fusing roller which is comprised by a metal conductor. A high-frequency current flows through the coil resulting in a high-frequency magnetic field that causes an induction eddy current in the fusing roller with the skin resistance of the fusing roller body causing joule heat generation to occur in the fusing roller itself.

Conversely, making the heating roller thinner has also been proposed because of the possibility of reducing the pre-heating time by means of a lower thermal capacity that lowers the quantity of heat generated by the heat generating body. Fusing devices however, are comprised such that the heating roller and pressing roller are normally brought into contact under a high pressure. And, because a fixed mechanical strength is required for the heating roller, there were limits on how much thinner the heating roller could be made making it obvious that there were also limits on reducing the pre-heating time by means of thinning the roller.

In order to solve the above-mentioned problems associated with the heating method in which high-frequency induction is used, a fusing roller with for example, a thin metal layer that functions as a heat generating body formed on the outer periphery of a cylindrical shaped ceramic that reduces the pre-heating time while simultaneously maintaining mechanical strength has been proposed in Japanese Laid-open Patent Application Sho 59-33476.

Further, in Japanese Laid-open Patent Application Sho 59-33474, a fusing roller with a heat generating thin metal tube that functions as the heat generating body is recessed in the outer periphery of a reinforced metal tube that has a slit formed on it to prevent the flow of induction current has been proposed. And, in Japanese Laid-open Patent Application Sho 59-33475, a fusing roller with a thin metal tube recessed in the outer periphery of an insulated reinforced tube has been proposed. Either of these fusing rollers are devices with the intent to reduce the pre-heating time while ensuring mechanical strength. Moreover, on the former reinforced metal tube, a plurality of thermally insulating concave channels are formed which extend in the peripheral direction to prevent heat conduction from the thin heating metal tube and on the outer periphery of the latter insulated reinforced tube, a plurality of thermally insulating concave portions are formed which extend in the axial direction to prevent heat conduction from the thin heat generating metal tube.

However, because the conventional fusing rollers disclosed in the above-mentioned Laid-open Patent Applications have compositions in which a thin heat-generating body is provided on the outer periphery of the core material, a ceramic with poor heat conduction properties is used as the core material and concave channels are formed in the core material for thermal insulation, the heat conduction in the longitudinal direction and circumferential direction of the rollers is almost non-existent.

Therefore, the temperature difference that frequently occurs in copying machines between the temperature at the region of the fusing roller where paper passes and the temperature at the region of the fusing roller where paper does not pass becomes extremely large when the mode is set in which recording paper that is smaller than the maximum paper width that can pass through the roller is continuously passed through. Because of this type of temperature unevenness, there were dangers such as reductions in the heat resisting lifespan of peripheral members and their suffering heat related damage and even further, there were problems such as partially uneven fusing when large-sized recording paper was passed through the roller immediately after the above-mentioned mode.

OBJECTS AND SUMMARY

The object of the present invention is to provide an improved induction heat fusing device.

Another object of the present invention is to provide an induction heat fusing device that maintains the strength of the fusing roller as well as reducing the pre-heating time.

A further object of the present invention is to provide an induction heat fusing device that can restrict temperature unevenness and maintain stable fusing performance irregardless of which paper pass mode is selected.

A further object of the present invention is to provide an improved fusing roller.

A further object of the present invention is to provide a fusing roller for an induction heat fusing device that reduces the pre-heating time while maintaining the strength of the fusing roller.

A further object of the present invention is to provide a fusing roller for an induction heat fusing device that can restrict temperature unevenness and achieve stable fusing performance irregardless of which paper pass mode is selected.

The above-mentioned objects are achieved by providing an induction heat fusing device comprising a fusing member having a nonmagnetic metallic base with good heat conduction properties and a magnetic metal layer formed on said base, and an induction coil arranged close to said fusing member that induces an induction current in the said magnetic metal layer to generate heat.

Further, the above-mentioned objects are achieved by providing a fusing member for an induction heat fusing device comprising a nonmagnetic metallic base with good heat conduction properties; and a magnetic metal layer formed on said base that is heated by means of an induction current induced by means of an induction coil.

These and other objects, advantages and featues of the invention will become apparent from the following description thereof taken in conjunction with the accompanying drawings which illustrate specific embodiments of the invention.

BRIEF DESCRIPTION OF THE DRAWINGS

In the following description, like parts are designated by like reference number throughout the several drawings.

DETAILED DESCRIPTION OF THE PREFERRED EMBODIMENTS

Figure 1:
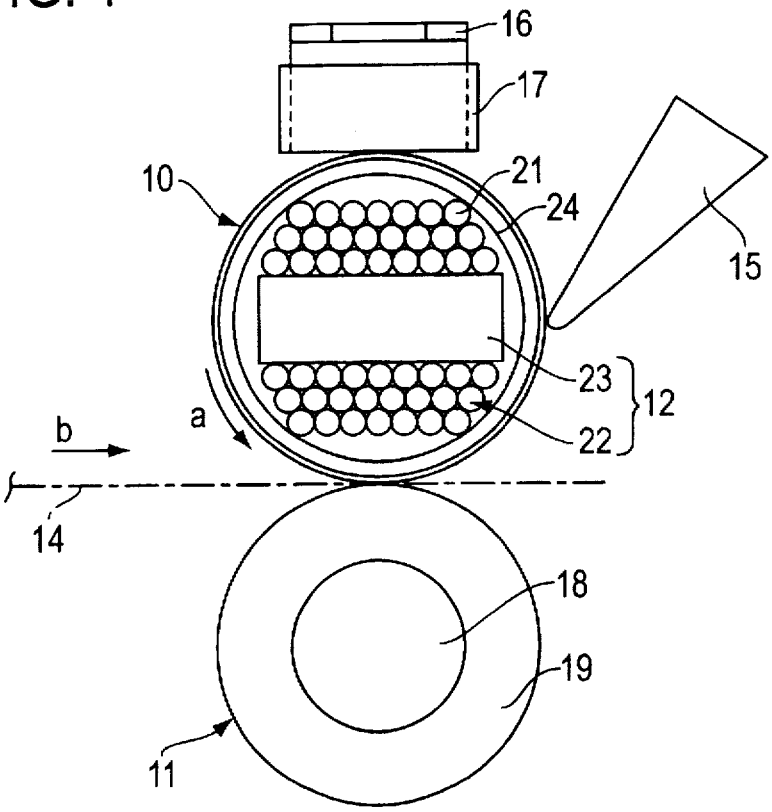
FIG. 1 is a cross-section showing an outline of the induction heat fusing device in which this invention is applied.

Referring now to the drawings, the preferred embodiments of the present invention will be described.

FIG. 1 is a cross-section showing the induction heat fusing device of the present invention.

Figure 2:
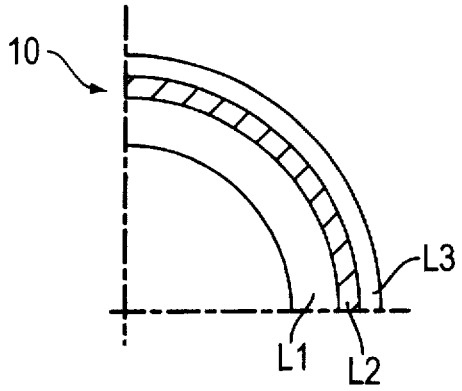
FIG. 2 is a partial expanded sectional view of the fusing roller used in the induction heat fusing device.

FIG. 2 is a partial expanded sectional view of the fusing roller used in the induction heat fusing device of FIG. 1.

As shown in FIG. 1, the induction heat fusing device incorporated into an image forming apparatus such as a copying machine or printer has a heating roller, or more precisely, a fusing roller 10 provided such that it can be driven to rotate in the direction of arrow "a" and a pressing roller 11 arranged making contact with said fusing roller 10 and is driven to rotate along with the rotation of the fusing roller 10.

A detailed description of the composition of the fusing roller 10 will be provided later but in brief, the roller is formed in a hollow cylindrical shape and inside the roller is arranged a coil assembly 12 that generates an induction current (eddy current) in the thin magnetic metal layer of the fusing roller 10.

The coil assembly 12 has an induction coil 22 formed by coiling copper wire 21 a number of times in one direction and a core 23 arranged at a right angle to the copper wire 21 of this induction coil 22 to form a magnetic path and is supported on a holder 24. For the coil 22, it is preferable to use a single or Litz copper wire having a fused layer and insulation layer on the surface. Further, the core 23 is comprised by a magnetic material, for example, ferrite core or lamination layer core.

The fusing roller 10 has sliding bearings formed on both of its ends and is mounted to a fusing unit frame (not shown in figure) to freely rotate. In addition, the fusing roller 10 has a drive gear (not shown in figure) fixed to one side and is driven to rotate by means of a drive source such as a motor connected to this drive gear. Moreover, the holder 24 is fixed to the fusing unit frame and does not rotate and is housed inside the roller 10 separated from the inner peripheral surface of the fusing roller 10 at a fixed gap.

A toner support member onto which is transferred the toner image not yet fused, or more precisely, a sheet 14 is fed from the left direction as indicated by arrow b in FIG. 1 and sent to the nip portion between the fusing roller 10 and the pressing roller 11. The sheet 14 is fed through the nip portion while the heat of the heated fusing roller 10 and the pressure exerted from both rollers 10, 11 are being applied to. By means of this action, the toner not yet fused is fused and a fusing toner image is formed on the sheet 14. The sheet 14 that passed through the nip portion naturally separates from the fusing roller 10 by means of the curvature of the fusing roller itself 10 or, as shown in FIG. 1, is forcibly separated from the fusing roller 10 by means of either a separation claw 15 provided such that the leading edge portion scrapes against the surface of the fusing roller 10. The sheet is then fed in a direction to the right in FIG. 1. This sheet 14 is fed by a paper delivery roller (not shown in figure) and delivered to a paper delivery tray.

A temperature sensor 16 that detects the temperature of the fusing roller 10 is provided above the fusing roller 10. This temperature sensor 16 is provided to press against the surface of the fusing roller 10 such that it is opposite to the side of the induction coil 22 with a gap between itself and the fusing roller 10. The temperature sensor 16 is comprised by, for example, a thermistor and, while the temperature of the fusing roller 10 is detected by this thermistor 16, the temperature of the fusing roller 10 is regulated by the flow of electricity to the induction coil 22 to maintain an optimum temperature of the fusing roller 10.

A thermostat 17 is further provided above the fusing roller 10 as a safety mechanism for cases when the temperature rises abnormally. This thermostat 17 presses against the surface of the fusing roller 10 and if the temperature reaches a previously set value, the contacts of the thermostat open to cutoff the flow of electricity to the induction coil 22. This prevents the fusing roller 10 from reaching high temperatures more than a fixed temperature.

A silicon rubber layer 19 that is a surface separation heat resistant rubber layer is formed on the periphery of a shaft core 18 of the pressing roller 11. Further, the holder 24 is formed from a heat resistant insulating engineering plastic and the sliding bearings and separation claw 15 are formed from a heat resistant slidable engineering plastic or other material.

As shown in the expanded view of FIG. 2, the fusing roller 10 has a hollow metal roller L1 having good heat conduction and nonmagnetic properties, a magnetic thin metal layer L2 formed on the outer periphery of said hollow metal roller L1 and comprised by a magnetic metal, and a heat resistant separation layer L3 formed on the outer periphery of said magnetic thin metal layer L2. Inside the hollow metal roller L1 is arranged the induction coil 22 that induces an induction current in the magnetic thin metal layer L2 to generate heat.

The thickness of the hollow metal roller L1 is determined from the viewpoint of improving the heat conduction while satisfying the mechanical strength required with respect to the diameter of the fusing roller 10. The thickness of the magnetic thin metal layer L2 is determined from the viewpoint of a desired temperature increase time and the range in which the layer can be formed.

The table below shows the specific magnetic permeabilities of various materials and the heat conduction rate at 200° C. of each of the materials.

TABLE

| Material | Specific magnetic permeability | Heat conduction rate (200° C.) [W/(mK)] |
|---|---|---|
| Ag | 1 | 430 |
| Al | 1 | 237 |
| Cu | 1 | 413 |
| $SiO_2$ | 1 | 1.14 |
| Ceramic | 1 | 30 |
| SUS304 | 1 | 16 |
| SUS430 | 1000 | 27 |
| Co | 150 | 122 |
| Ni | 400 | 106 |
| Fe | 7000 | 94 |
| Ni—Fe alloy | 10000 | 100 |

As shown in the table above, for a material which has good heat conduction properties and nonmagnetic properties suitable for the hollow metal roller L1, a material with a specific magnetic permeability of about 1 and a heat conduction rate of 200 W/(m·k) or more (at 200° C.) is suitable. Concretely, the hollow metal roller L1 is formed from materials including aluminum, silver, copper or an alloy of these.

Furthermore, the magnetic metal is normally a metal with a specific magnetic permeability of about 100 or more. As the specific magnetic permeability becomes larger, the magnetic flux density increases making it easier to heat. Concretely, the magnetic thin metal layer L2 is formed from SUS430, cobalt, nickel, iron or a nickel-iron alloy (permalloy). This magnetic thin metal layer L2 is formed on the outer periphery of the hollow metal roller L1 by means of a well-known film adhesion method such as plating, evaporation, sputtering or coating.

The heat resistant separation layer L3 is formed by coating the outer periphery of the magnetic thin metal layer L2 with a fluorine containing resin.

When the fusing roller 10 is constructed as described above and a high-frequency current is passed through the induction coil 22, because the hollow metal roller L1 is comprised by a material having nonmagnetic properties, it is difficult for an induction current to generate heat and almost no heat is generated. Conversely, because the magnetic thin metal layer L2 is comprised by a magnetic metal, a high-frequency induction current is induced and heated. The hollow metal roller L1 functions as a core bar to maintain the mechanical strength of the entire fusing roller 10. Because the magnetic thin metal layer L2 that is a heat generating body is formed thin and designed to have a lower thermal capacity, its temperature rises rapidly. As a result, reductions in the pre-heating time and lowering of power consumption are made possible.

The hollow metal roller L1 is further comprised by a material having good heat conduction properties and moreover, since a means for thermal insulation is not formed on the outer periphery of the hollow metal roller L1 as well, the heat conduction of the entire fusing roller 10 is improved making it easier to transmit the heat of the magnetic thin metal layer L2 in the longitudinal direction and circumferential direction of the roller. Therefore, the temperature difference between the region where the paper passes through the fusing roller 10 and the region where the paper does not pass becomes small when the mode to pass the paper through the roller is set to continuously pass recording paper that is smaller than the maximum paper width that can pass through the roller. Restricting the temperature unevenness of the fusing roller 10 in this way results in the elimination of reductions in the heat resisting lifespan of peripheral members as well as any heat related damage they may suffer. In addition, the occurrence of partially uneven fusing when large-sized recording paper is passed through the roller immediately after the above-mentioned mode is eliminated.

Therefore, according to the fusing roller 10 implemented in the present first embodiment, the pre-heating time is reduced while sufficiently maintaining mechanical strength. It is further possible to restrict temperature unevenness and achieve stable fusing performance irregardless of which paper pass mode is selected.

Moreover, an insulated hollow roller can be further provided inside the hollow metal roller L1 and an induction coil can be provided inside this insulated hollow roller. If constructed this way, electrical current that flows in the induction coil which is the heat source can be electrically cutoff from either the nonmagnetic hollow metal roller or magnetic thin metal layer. For example, electrical insulation can be maintained and damage to the entire fusing device prevented even when the coating of the induction coil is damaged due to an excessively high temperature or other factor.

Figure 3:
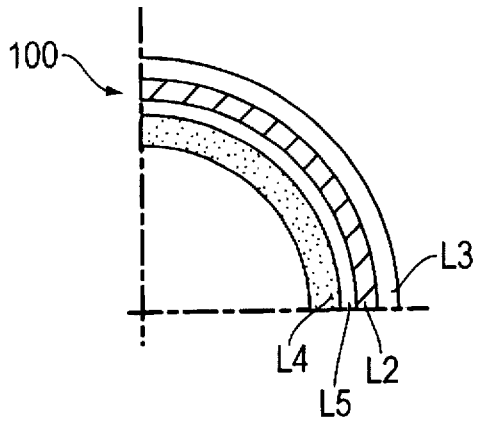
FIG. 3 is a partial expanded sectional view of another fusing roller used in the induction heat fusing device.

FIG. 3 is a partial expanded sectional view of another fusing roller 100 used in place of the induction heat fusing device shown in FIG. 1.

As shown in the figure, this fusing roller 100 has a hollow roller L4 having insulating and nonmagnetic properties, a heat conduction layer L5 formed on the outer periphery of said hollow roller L4 and is comprised by a material having good heat conduction and nonmagnetic properties, a magnetic thin metal layer L2 formed on the outer periphery of said heat conduction layer L5 and comprised by a magnetic metal, and a heat resistant separation layer L3 formed on the outer periphery of said magnetic thin metal layer L2. Inside the hollow roller L4 is arranged an induction coil 22 in the magnetic thin metal layer L2.

The thickness of the hollow roller L4 is determined from the viewpoint of satisfying the mechanical strength required with respect to the diameter of the fusing roller 100. The thickness of the heat conduction layer L5 is determined from the viewpoint of a desired heat conduction performance and the range in which the layer can be formed.

As shown in the above-mentioned table, for a material having nonmagnetic properties, a material with a specific magnetic permeability of about 1 is suitable. Concretely, the hollow roller L4 having electrically insulated properties is formed from glass, insulated ceramic or other like materials.

Further, for a material which has good heat conduction properties and nonmagnetic properties, a material with a specific magnetic permeability of about 1 and a heat conduction rate of 200 W/m·k or more (at 200° C.) is suitable. Concretely, the heat conduction layer L5 is formed from materials including aluminum, silver, copper or an alloy of these. The heat conduction layer L5 is formed on the outer periphery of the hollow roller L4 by means of a well-known film adhesion method such as plating, evaporation, sputtering or coating.

Because the magnetic thin metal layer L2 and the heat resistant separation layer L3 are formed in the same manner to the fusing roller 10 shown in FIG. 2, their description is omitted.

When the fusing roller 100 is constructed as described above and a high-frequency current is passed through the induction coil 22, because the hollow roller L4 and the heat conduction layer L5 are comprised by material having nonmagnetic properties, it is difficult for an induction current to generate heat and almost no heat is generated and conversely, a high-frequency induction current is induced and the magnetic thin metal layer L2 is heated. The hollow roller L4 functions as a core bar to maintain the mechanical strength of the entire fusing roller 100. Because the magnetic thin metal layer L2 that is a heat generating body is formed thin and designed to have a low thermal capacity, its temperature rises rapidly. As a result, reductions in the pre-heating time and lowering of power consumption are made possible.

The heat conduction layer L5 is further comprised by a material having good heat conduction properties and moreover, since a means for thermal insulation is not formed on the outer periphery of the heat conduction layer L5 as well, the heat conduction of the entire fusing roller 100 is improved making it easier to transmit the heat of the magnetic thin metal layer L2 in the longitudinal direction and circumferential direction of the roller. Therefore, in like manner to the first embodiment, the temperature unevenness that occurs in cases such as when the mode to pass the paper through the roller is set to continuously pass recording paper that is smaller than the maximum paper width that can pass through the roller can be made very small and, as a result, partially uneven fusing when large-sized recording paper is passed through the roller immediately after the above-mentioned mode does not occur.

Furthermore, because the hollow roller L4 has insulating properties, electrical current that flows in the induction coil 22 which is the heat source can be electrically cutoff from either the heat conduction layer L5 or the magnetic thin metal layer L2. For example, electrical insulation can be maintained and damage to the entire fusing device prevented even when the coating of the induction coil 22 is damaged due to an excessively high temperature or other factor.

Therefore, according to this fusing roller 100, the pre-heating time is reduced while sufficiently maintaining mechanical strength. It is further possible to restrict temperature unevenness and achieve stable fusing performance irregardless of which paper pass mode is selected. Moreover, the electrical insulation between the induction coil 22 and the entire fusing roller 100 can be maintained.

Figure 4:
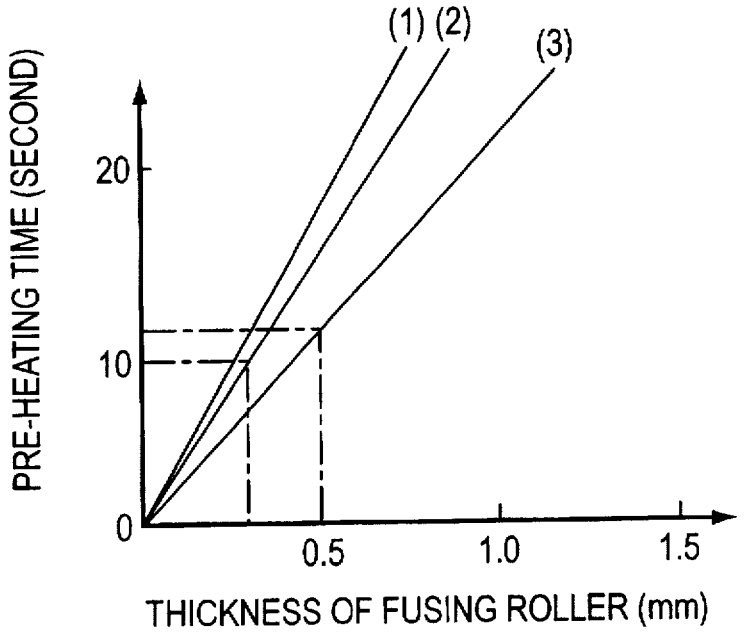
FIG. 4 is a graph showing the relationship between the thickness of the fusing roller and the pre-heating time.

FIG. 4 is a graph showing the relationship between the thickness of the fusing roller and the pre-heating time. As the pre-heating time the time for the temperature to rise from room temperature (20° C.) to a regulated temperature (180° C.) was measured. Each of the fusing rollers (1) to (3) which were the objects of the measurement were formed from nickel, iron and aluminum, respectively, in a hollow cylindrical shape with a diameter of ϕ30 mm. The heating methods were as follows; (1) Ni, high-frequency induction heating method (2) Fe, high-frequency induction heating method (3) Al, halogen heater method.

The graph shows data for each of the rollers when 900 W was applied.

As is apparent from this graph, although it is preferable to form a thin fusing roller that is the heat generating body to lower the thermal capacity from the viewpoint of reducing the pre-heating time, in order to satisfy a fixed mechanical strength, there is a limit on how thin the fusing roller can be formed. For iron and aluminum, it is considered that the thickness must be at least 0.5 mm or more for a fusing roller with a ϕ30 mm. Furthermore, it is considered difficult to maintain sufficient mechanical strength for fusing rollers comprised by nickel.

Figure 5:
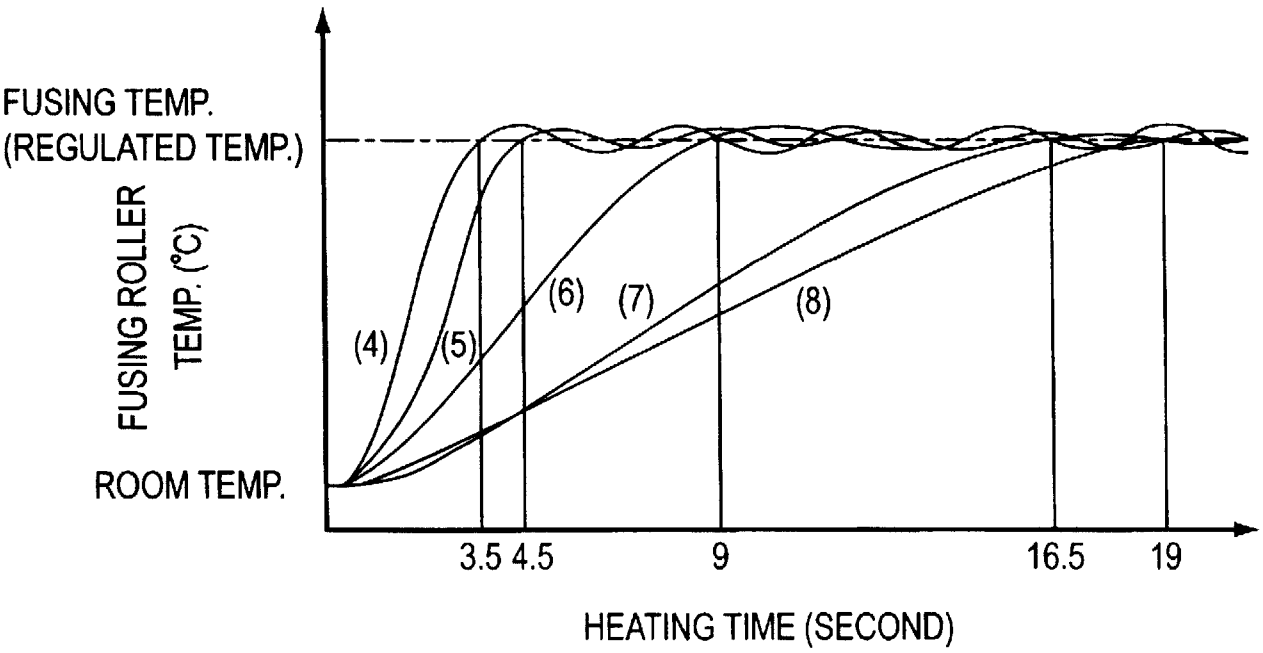
FIG. 5 is a graph showing the relationship between the heating time until the fusing temperature is reached when heated from room temperature and the fusing roller temperature.

FIG. 5 is a graph showing the relationship between the heating time and the surface temperature of the fusing roller when heated from room temperature until the fusing temperature (regulated temperature) is reached. Each of the fusing rollers (4) to (8) which were the objects of the measurement were formed with a diameter of ϕ30 mm. They were roughly classified into fusing rollers (4) and (7) which were the only ones formed in a hollow cylindrical shape from metal that is the heat generating body and fusing rollers (5), (6), and (8) which had a double construction provided with a metal layer that is the heat generating body on the outer periphery of the roller creating a core formed in a hollow cylindrical shape. The material of the heat generating body and the core, the thickness, and the heating methods were as follows; (4) Heat generating body: Ni thickness 0.03 mm, high-frequency induction heating method (5) Heat generating body: Ni thickness 0.03 mm, core: Al thickness 0.5 mm, high-frequency induction heating method (6) Heat generating body: Ni thickness 0.03 mm, core: ceramic thickness 0.5 mm, high-frequency induction heating method (7) Heat generating body: Al thickness 0.5 mm, halogen heater method (8) Heat generating body: Ni thickness 0.03 mm, core: Fe thickness 0.5 mm, high-frequency induction heating method The graph shows data for each of the rollers when 900 W was applied.

The pre-heating times (in seconds) of each fusing roller are shown below. (4) 3.5 (5) 4.5 (6) 9 (7) 16.5 (8) 19

As is apparent from these results, according to the fusing roller (5) of this embodiment which utilizes the high-frequency induction heating method, the pre-heating time could be greatly reduced compared to the fusing roller (7) that utilizes the conventional halogen heater method. Further, because fusing roller (5) uses aluminum having good heat conduction properties as the core, it became easier to transmit the heat generated by the thin nickel layer that is the heat generating body in the longitudinal direction and circumferential direction of the roller compared to the fusing roller (6) that used ceramic as the core which allowed the pre-heating time to be reduced by half. Moreover, because aluminum having nonmagnetic properties is used as the core bar in this embodiment, the magnetic flux does not concentrate in the core bar improving the heat generation efficiency at the thin nickel layer compared to the fusing roller (8) that used iron that is a strong magnetic metal as the core which allowed the pre-heating time to be greatly reduced. Even though the roller (4) comprised by only a thin nickel layer had the shortest pre-heating time, because it cannot maintain the mechanical strength required in a fusing roller as previously described, the roller (4) cannot be utilized in actual equipment.

Figure 6:
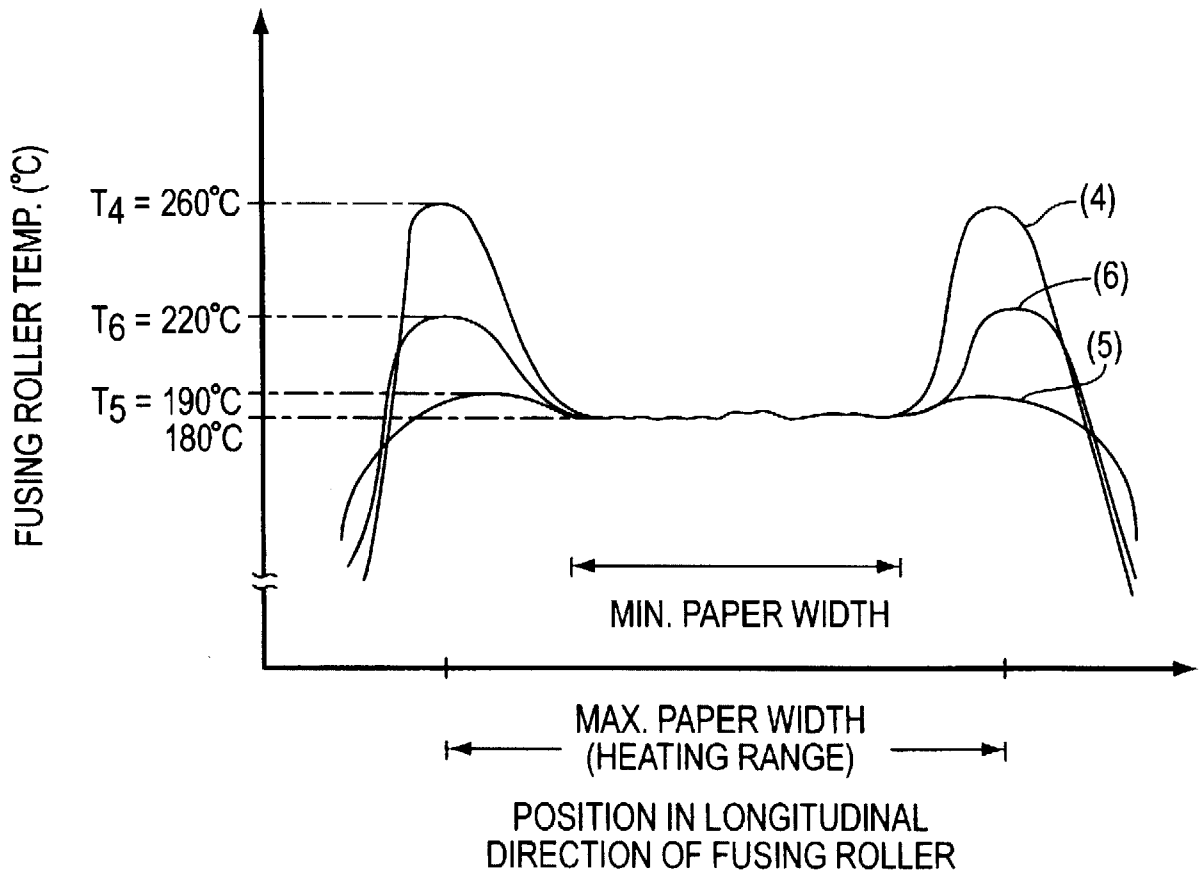
FIG. 6 is a graph showing the temperature distribution in the longitudinal direction of the fusing roller when small-sized recording paper is continuously passed through the roller.

FIG. 6 is a graph showing the measured results of the temperature distribution in the longitudinal direction of the fusing roller when a mode is selected in which small-sized recording paper is continuously passed through the roller. The fusing rollers which were the objects of the measurement are rollers (4), (5) and (6) above.

As is apparent from this figure, in the fusing roller (5) of this embodiment which used aluminum as the core bar, it became easier to transmit the heat of the region where paper does not pass located close to the end of the roller to the region where paper passes at the center portion of the roller compared to the fusing roller (6) that used ceramic as the core material. This allowed the temperature rise at the region where paper does not pass to be reduced from T6° C. (220° C.) to T5° C. (190° C.) which in turn allowed the temperature of the region where paper does not pass to be controlled within a regulated temperature range of ±10° C. The result of controlling the temperature unevenness of the fusing roller in this manner achieves a stable fusing performance irregardless of which paper pass mode is selected. Furthermore, the roller (4) comprised by only a thin nickel layer has even worse heat conduction in the longitudinal direction of the roller because of its thinness resulting in the temperature of the region where paper does not pass rising up to T4° C. (260° C.). And, even if the roller (4) is utilized in actual equipment despite the fact that it has strength problems, expensive heat-resistant materials must be used in the materials which comprise the peripheral members and in addition, if large-sized recording paper is passed through the roller under this state, poor fusing will occur.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An induction heat fusing device comprising:

a fusing member comprising a nonmagnetic metallic base, comprised of a material with a specific magnetic permeability of about 1 and a heat conduction rate of 200 (W/m·k) or more at 200° C. said nonmagnetic metallic base having good heat conduction properties and, said nonmagnetic metallic base including a magnetic metal layer formed on said base; and an induction coil arranged close to said fusing member that induces an induction current in said magnetic metal layer to generate heat.

2. The induction heat fusing device as claimed in claim 1 wherein said nonmagnetic metallic base is formed from a material including aluminum.

3. The induction heat fusing device as claimed in claim 1 wherein said nonmagnetic metallic base is formed from a material including silver.

4. The induction heat fusing device as claimed in claim 1 wherein said nonmagnetic metallic base is formed from a material including copper.

5. The induction heat fusing device as claimed in claim 1 wherein said fusing member further has a heat resistant separation layer formed on said magnetic matal layer.

6. The induction heat fusing device as claimed in claim 1 wherein said fusing member is an endless rotating member.

7. The induction heat fusing device as claimed in claim 6 wherein said fusing member is a roller.

8. An induction heat fusing device comprising:

a fusing member comprising a nonmagnetic metallic base with good heat conduction properties and a magnetic metal layer formed on said base, said magnetic metal layer comprised of a material with a specific magnetic permeability of about 100 or more; and an induction coil arranged close to said fusing member that induces an induction current in said magnetic metal layer to generate heat.

9. The induction heat fusing device as claimed in claim 8 wherein said magnetic metal layer is formed from SUS430.

10. The induction heat fusing device as claimed in claim 8 wherein said magnetic metal layer is formed from cobalt.

11. The induction heat fusing device as claimed in claim 8 wherein said magnetic metal layer is formed from nickel.

12. The induction heat fusing device as claimed in claim 8 wherein said magnetic metal layer is formed from iron.

13. The induction heat fusing device as claimed in claim 8 wherein said magnetic metal layer is formed from a nickel-iron alloy.

14. An induction heat fusing device comprising:

an endless rotating member including a nonmagnetic metallic base with good heat conduction properties and a magnetic metal layer formed on said base; and an induction coil arranged inside said rotating member that induces an induction current in said magnetic metal layer to generate heat.

15. The induction heat fusing device as claimed in claim 14 wherein said nonmagnetic metallic base is comprised by a material with a specific magnetic permeability of about 1 and a heat conduction rate of 200 (W/m·k) or more at 200° C.

16. The induction heat fusing device as claimed in claim 14 wherein said magnetic metal layer is comprised by a material with a specific magnetic permeability of about 100 or more.

17. The induction heat fusing device as claimed in claim 14 wherein said fusing member further comprises a heat resistant separation layer formed on said magnetic matal layer.

18. The induction heat fusing device as claimed in claim 14, wherein said magnetic layer is formed directly on said base.

19. An induction heat fusing device comprising:

a fusing member including a base member with electrically insulating and nonmagnetic properties, a heat conduction layer formed on said base member, and a magnetic metal layer formed on said heat conduction layer; and an induction coil arranged close to said fusing member that induces an induction current in said magnetic metal layer to generate heat.

20. The induction heat fusing device as claimed in claim 19 wherein said base member is comprised of a material with a specific magnetic permeability of about 1.

21. The induction heat fusing device as claimed in claim 20 wherein said base member is formed from glass.

22. The induction heat fusing device as claimed in claim 20 wherein said base member is formed from insulated ceramic.

23. The induction heat fusing device as claimed in claim 19 wherein said magnetic metal layer is comprised of a material with a specific magnetic permeability of about 100 or more.

24. The induction heat fusing device as claimed in claim 23 wherein said magnetic metal layer is formed from SUS430.

25. The induction heat fusing device as claimed in claim 23 wherein said magnetic metal layer is formed from cobalt.

26. The induction heat fusing device as claimed in claim 23 wherein said magnetic metal layer is formed from nickel.

27. The induction heat fusing device as claimed in claim 23 wherein said magnetic metal layer is formed from iron.

28. The induction heat fusing device as claimed in claim 23 wherein said magnetic metal layer is formed from a nickel-iron alloy.

29. The induction heat fusing device as claimed in claim 19 wherein said fusing member further includes a heat resistant separation layer formed on said magnetic metal layer.

30. The induction heat fusing device of claim 19, wherein said magnetic metal layer is formed directly on said heat conduction layer.

31. A fusing roller for an induction heat fusing device comprising:

a nonmagnetic metallic hollow roller, comprised of a material with a specific magnetic permeability of about 1 and a heat conduction rate of 200 (W/m·k) or more at 200° C., said metallic hollow roller having good heat conduction properties; and a magnetic metal layer formed on the outer peripheral surface of said nonmagnetic metallic hollow roller that is heated by means of an induction current induced by means of an induction coil.

32. The fusing roller as claimed in claim 31 wherein said hollow roller is formed from a material including aluminum.

33. The fusing roller as claimed in claim 31 wherein said hollow roller is formed from a material including silver.

34. The fusing roller as claimed in claim 31 wherein said hollow roller is formed from a material including copper.

35. A fusing roller for an inductoin heat fusing device comprising:

a nonmagnetic metallic hollow roller with electrorically insulating and nonmagnetic properties;

a heat conduction layer formed on said base member; and a magnetic metal layer formed on said heat conduction layer.

36. A fusing roller for an induction heat fusing device comprising:

a non-magnetic metallic hollow roller with good heat conduction properties; and a magnetic metal layer formed on the outer peripheral surface of said non-magnetic metallic hollow roller that is heated by means of an induction current induced by means of an induction coil, said magnetic metal layer comprised of a material with a specific magnetic permeability of about 100 or more.

37. The fusing roller as claimed in claim 36 wherein said magnetic metal layer is formed from SUS430.

38. The fusing roller as claimed in claim 36 wherein said magnetic metal layer is formed from cobalt.

39. The fusing roller as claimed in claim 36 wherein said magnetic metal layer is formed from nickel.

40. The fusing roller as claimed in claim 36 wherein said magnetic layer is formed from iron.

41. The fusing roller as claimed in claim 36 wherein said magnetic metal layer is formed from a nickel-iron alloy.

42. A fusing roller for an induction heat fusing device comprising:

a nonmagnetic metallic hollow roller with electrically insulating and nonmagnetic properties;

a heat conduction layer formed on said nonmagnetic metallic hollow roller; and a magnetic metal layer formed on said heat conduction layer.

43. The fusing roller as claimed in claim 42 wherein said hollow roller is comprised of a material with a specific magnetic permeability of about 1.

44. The fusing roller as claimed in claim 43 wherein said hollow roller is formed from glass.

45. The fusing roller as claimed in claim 43 wherein said hollow roller is formed from insulated ceramic.

46. The fusing roller as claimed in claim 42 wherein said magnetic metal layer is comprised of a material with a specific magnetic permeability of about 100 or more.

47. The fusing roller as claimed in claim 46 wherein said magnetic metal layer is formed from SUS430.

48. The fusing roller as claimed in claim 46 wherein said magnetic metal layer is formed from cobalt.

49. The fusing roller as claimed in claim 46 wherein said magnetic metal layer is formed from nickel.

50. The fusing roller as claimed in claim 46 wherein said magnetic metal layer is formed from iron.

51. The fusing roller as claimed in claim 46 wherein said magnetic metal layer is formed from a nickel-iron alloy.

52. The fusing roller as claimed in claim 46 further comprising a heat resistant separation layer formed on said magnetic metal layer.

53. The fusing roller as claimed in claim 42, wherein said magnetic metal layer is formed directly on said heat conduction layer.

54. An induction heat fusing device comprising:

a fusing member comprising a nonmagnetic metallic base with good heat conduction properties and a magnetic metal layer formed directly on said base; and an induction coil arranged close to said fusing member that induces an induction current in said magnetic layer to generate heat.

55. A fusing roller for an induction heat fusing device comprising:

a nonmagnetic metallic hollow roller with good heat conduction properties; and a magnetic metal layer formed directly on the outer peripheral surface of said nonmagnetic metallic hollow roller that is heated by means of an induction current induced by means of an induction coil.

* * * * *

UNITED STATES PATENT AND TRADEMARK OFFICE

CERTIFICATE OF CORRECTION

PATENT NO. : 5,768,673

DATED : June 16, 1998

INVENTOR(S) : Yuusuki Morigami

It is certified that error appears in the above-identified patent and that said Letters Patent is hereby corrected as shown below:

Cover page, in title, line 3: Delete "SUFING" and insert --FUSING--

Cover page, under "Inventors": Delete "Toyohashi" and insert --Aichi-Ken--

Col. 10, line 15: Delete "matal" and insert --metal--

Col. 10, line 57: Delete "matal" and insert --metal--

Signed and Sealed this

Fifth Day of January, 1999

*Attest:*

*Attesting Officer*

*Acting Commissioner of Patents and Trademarks*